United States Patent [19]

Brami et al.

[11] Patent Number: 4,799,348

[45] Date of Patent: Jan. 24, 1989

[54] METHOD AND EQUIPMENT FOR MAKING A RIGID SLAB ENABLING TO CARRY A BUILDING

[76] Inventors: Max Brami, 60 rue Saint-HonoréF-75001 Paris; Pierre Mazarguil, 44 rue du Four, F-75006 Paris, both of France

[21] Appl. No.: 847,408

[22] PCT Filed: Jun. 18, 1985

[86] PCT No.: PCT/FR85/00159

§ 371 Date: Feb. 19, 1986

§ 102(e) Date: Feb. 19, 1986

[87] PCT Pub. No.: WO86/00358

PCT Pub. Date: Jan. 16, 1986

[30] Foreign Application Priority Data

Jun. 19, 1984 [FR] France ..... 84 09595

[51] Int. Cl.[4] ..... E04B 1/00; E04G 21/00; E02D 27/02

[52] U.S. Cl. ..... 52/742; 52/169.1; 52/169.9; 52/169.11; 249/13; 264/31

[58] Field of Search ..... 52/169.9, 169.1, 167, 52/320, 323, 324, 577, 169.11, 742; 249/13; 264/31

[56] References Cited

U.S. PATENT DOCUMENTS

| | | | |
|---|---|---|---|
| 1,165,985 | 12/1915 | Lindau | 52/324 |
| 1,353,373 | 9/1920 | Allbright | 52/320 X |
| 1,775,234 | 9/1930 | Brostrom | 52/324 |
| 1,892,311 | 12/1932 | MacDonald | 52/577 X |
| 2,282,452 | 5/1942 | Brown | 52/742 |
| 2,298,184 | 10/1942 | Rosenberg | 52/169.11 X |
| 2,453,609 | 11/1948 | Whitehouse . | |
| 2,677,165 | 5/1954 | Copenhaver et al. | 264/31 |
| 2,911,794 | 11/1959 | Pearson . | |
| 3,166,871 | 1/1965 | Simison | 264/31 X |
| 3,316,721 | 5/1967 | Heilig . | |
| 3,468,094 | 9/1969 | Campbell | 52/169.9 X |
| 3,543,458 | 12/1970 | Guritz | 264/31 X |
| 3,555,751 | 1/1971 | Thorgusen | 52/169.9 X |
| 3,797,800 | 3/1974 | Loy | 249/13 |
| 4,179,104 | 12/1979 | Skinner et al. | 52/167 X |
| 4,211,504 | 7/1980 | Sivachenko . | |
| 4,341,491 | 7/1982 | Neumann . | |
| 4,365,451 | 12/1982 | Nelson | 52/169.9 |

FOREIGN PATENT DOCUMENTS

| | | | |
|---|---|---|---|
| 544163 | 7/1957 | Canada | 52/169.1 |
| 2757465 | 6/1979 | Fed. Rep. of Germany . | |
| 2233857 | 1/1975 | France . | |
| 563428 | 8/1944 | United Kingdom | 52/723 |

*Primary Examiner*—Alfred C. Perham
*Attorney, Agent, or Firm*—William A. Drucker

[57] ABSTRACT

Pin point foundations are formed, the ground is flattened and levelled at the level of these foundations, peripheral recoverable shuttering is disposed on the ground and continuous rows of non recoverable shuttering defining the ribs are disposed at the center. The rows of shuttering are spaced apart by baryte cardboard elements providing sealing and insulation. On the upper face of the non recoverable shuttering are disposed means for spacing the trellis work reinforcing the floor. Then the concrete is poured by pumping and, after drying out the floor, only the peripheral shuttering is recovered.

8 Claims, 3 Drawing Sheets

METHOD AND EQUIPMENT FOR MAKING A RIGID SLAB ENABLING TO CARRY A BUILDING

The invention relates to a process for economically forming a concrete, flooring constructed on an earth platform and bearing on pin point foundations, as well as apparatus for implementing this process.

A construction without a basement, and in particular individual houses without a basement, are generally erected on perimetric walls built on the ground, or at least to the regulation frost free depth, with concrete poured between these walls to form a non supporting floor. A more interesting solution in so far as insulation, both to cold and dampness, is concerned consists in forming a cavity, i.e.in forming a supporting floor independent of the ground and resting on the perimetric walls. This solution is of course more costly than the preceding one, since it requires perimetric walls to be built to a great height.

The object of the present invention is to overcome the drawbacks of the known solutions outlined above and it proposes providing all the advantages of the cavity by using a particularly economic process.

The process of the invention consists in forming pin point foundations, either by means of wells concreted to the regulation depth or on the resisting layers of the ground, or by means of micro-piles, these foundations being set up in a regular pattern defined by the dimensions of the floor to be formed and the weight of the building, in levelling the ground at the level of said pin point foundations, disposing on the ground thus prepared a recoverable shuttering at the periphery of the floor to be formed then non recoverable shuttering elements in the center for forming the ribs of the floor with possibly means for connecting these elements together so as to ensure the continuity of each rib, disposing elements for sealing, insulating and spacing the bottoms of beams and ribs between the rows of non recoverable shuttering elements, reinforcing the periphery and rib beams, disposing a reinforcement trellis for the floor, then pouring concrete over the assembly thus formed, generally by pumping.

The process allows regular through passages to be formed in the web of the periphery beams and girders for ventilating underneath the floor, or possibly for passing ducts therethrough which might have been forgotten before pouring of the concrete.

It will be understood that, providing the pin point foundations have been provided at a sufficient level, the process o the invention allows a basement to be formed subsequently, if such should prove desirable one day, without underpinning the building and so at very low cost.

According to the invention, the apparatus for implementing the process comprises non recoverable shuttering elements made from a light and strong material. These non recoverable shuttering elements may for example be formed by blocks of expanded plastic material foam, or from cardboard caissons reinforced by a cell like network. The cardboard caissons have the advantage of being delivered flat and are set up in volume on the work site, without requiring special tools, with reinforcing cross pieces.

The non recoverable shuttering elements are fitted end to end by means of special elements, called connection elements, for forming a rib continuity. These special elements may form shuttering for an intermediate cross beam reinforcing the rigidity of the floor. By extension of this idea, the shuttering elements could be square so as to form a "honeycomb" floor if the conditions of use or load require it.

The connection elements may comprise reservations serving as through passages perpendicular to the ribs.

The rigidity of the floor is obtained by the height of the ribs, formed economically because of the low cost of the non recoverable shuttering.

In their upper part, the non recoverable shuttering elements may receive devices for spacing the strengthening trellis work of the floor. Depending on the nature of the floor to be formed, the spacers may be fitted to one or more trellis work layers.

Between the rows of non recoverable shuttering elements are disposed spacer elements which define the width of the beams. These spacer elements may be made from baryta cardboard, for sealing the capillary rise through the ribs. The spacer elements of the shuttering may have a U shaped profile, have a complementary insulation on the under face and comprise pieces for spacing the reinforcement. The reinforcement of the beams will be symmetrical and will be calculated for the rib with the longest reach.

Between the pin point foundations and the rigid floor, a resilient material may be advantageously disposed which confers an antiseismic character on the construction.

In accordance with the invention, in the case of uneven or rocky ground, the rib bottoms may be made flush with the level of the highest point. For this, with the pin point foundations themselves made flush with this level, the outer, perimetric shuttering is then formed in two parts, a first part being flush with the level of the floor bottom and with the foundations, so as to thus define an irregular volume which may be filled provisionally by sand or by a powdery material, supporting the bottom of the floor and the non recoverable shuttering, and a second part formed by vertical side shuttering elements of a thickness of the ribs increased by that of the compression floor, allowing casting of the floor. After this latter has dried and the shuttering has been removed, the sand is eliminated naturally.

The process of the invention is particularly usable when, during casting of the floor on an earth platform, study of the bearing structure of the floor requires the construction of beams or longitudinal members of a height greater than the thickness of the floor. Up to present, such a construction assumed:

- an overdepth of the excavations, allowing positioning of lateral shuttering;
- shuttering and casting of the structure;
- removal of the shuttering and filling to the low level of the floor;
- casting of the floor.

According to an extension of the process of the invention, it is possible to form the floor and the bearing structure in a single casting. For this, excavations are made corresponding to the beams or longitudinal members to be obtained, whose bottom is levelled, non recoverable shuttering is placed in these excavations and fixed to the reinforcements of the beams of longitudinal members to be obtained, this non recoverable shuttering retaining the filling earth while being maintained, by wedging means, correctly spaced with respect to the steel work of these reinforcements, then the non recoverable shuttering for forming the ribs of the floor as explained above are disposed on the ground between the beams or longitudinal members, then the concrete is poured, thus forming in a single operation the beams or longitudinal members and the floor itself.

The purpose of the non recoverable shuttering surrounding the reinforcement of the beams or longitudinal members used in accordance with the process of the invention, is:

- to give to the buried part of the beams or longitudinal members a clean surface condition;
- to retain the filling earth at a good distance from the steel work because of the presence of the wedges;
- to arrange so that the pressure of the concrete during casting is exerted on the filling earth.

The shuttering may be formed with any light and rigid material such as cardboard, wood fiber, plastic material or similar. The choice of shuttering material will depend on the nature of the soil. The closer the soil may be cleanly cut to a dimension very close to that of the beam or longitudinal member to be formed (and thus there will be less filling), the lighter the shuttering may be. On the other hand, the more the soil is powdery, the wider the excavation and there is some filling up and the more rigid the material must be and the greater the number of wedges or spacers.

Advantageously, the shuttering may receive internally sealing which will prevent possible infiltration through underpressure, thus allowing the construction of a sealed lining.

For a better understanding of the process of the invention and of the means required for implementing same, two preferred embodiments will be described hereafter, by way of example with non limiting character, with reference to the accompanying schematical diagram in which.

Figure 1:
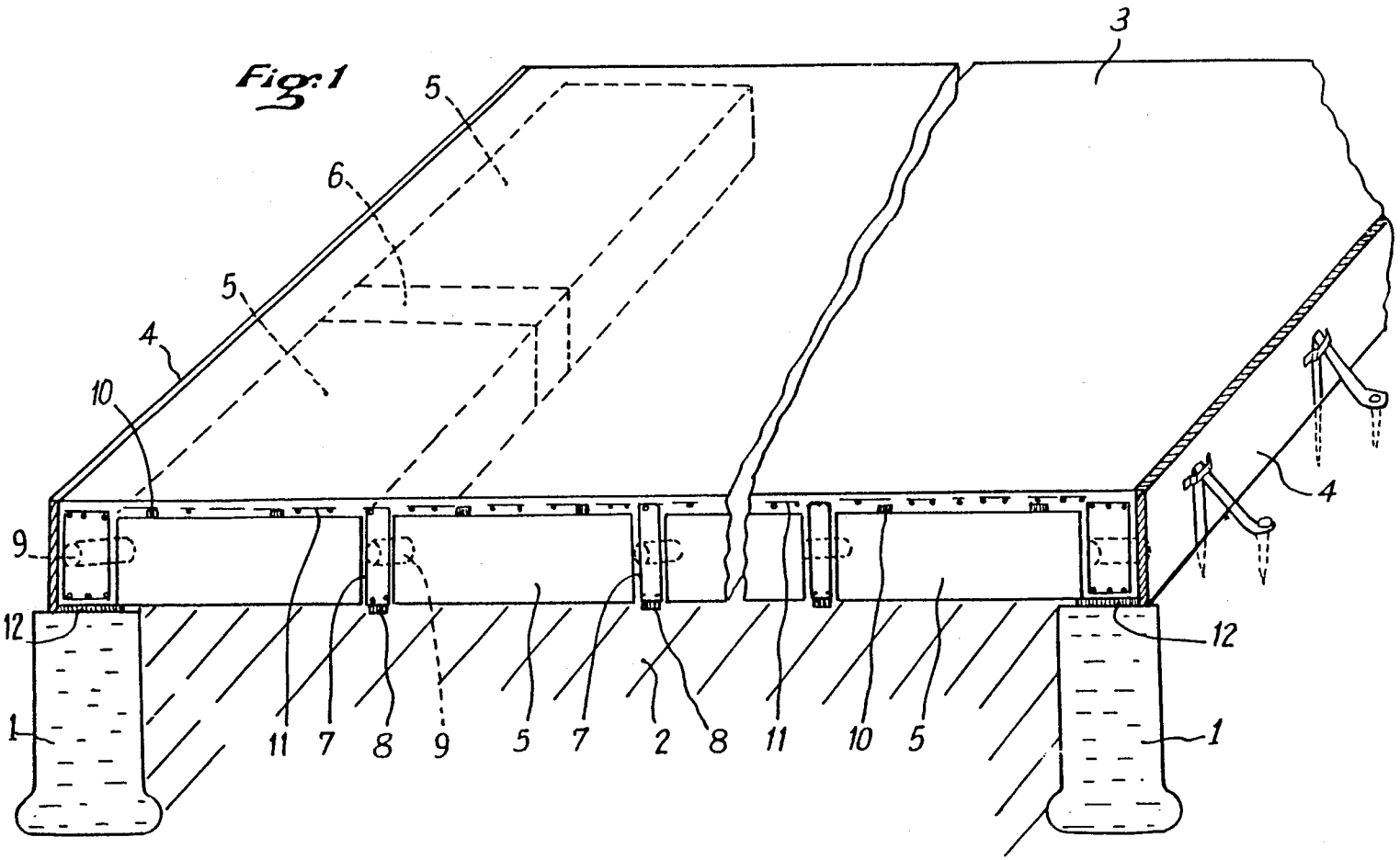
FIG. 1 is a perspective view partially in vertical section, of a floor obtained in accordance with the process of the present invention.

Referring to FIG. 1, there are shown at 1 concrete filled wells forming foundations going down to the resistant layers of the soil. Although only two wells 1 are visible in the Figure, it will be readily understood that there is a well at each corner of the floor to be formed. Between wells 1, the ground 2 is flattened and levelled at the level of the pin point foundations formed by wells 1.

On ground 2 recoverable shuttering 4 is disposed at the periphery of the floor 3 to be formed. In the center, non recoverable shuttering elements 5 are disposed connected together by connection elements 6 for ensuring the continuity of the ribs of the floor. In the example shown, the non recoverable shuttering elements are formed by cardboard caissons delivered flat and set up in volume on the worksite, with reinforcing cross pieces, without requiring special tools.

Although it has not been shown in the drawings, the connection element 6 could comprise through passages perpendicular to the ribs.

Between the shuttering rows 5, forming the ribs of the floor 3, are disposed spacer elements 7 which define the width of the beam. The spacer elements 7 are formed from bituminous cardboard, to insure sealing and prevent using a writer through the ribs, and have a U shaped profile. Elements 7 comprise on their underface an insulation 8, for example polystyrene, and may have spacers (not shown in the drawings) for the reinforcement of the beams. Through passages 9 are reserved in the spacer elements 7.

On the upper face of the non recoverable shuttering elements 5 are disposed spacer members 10, formed by pieces of cardboard for separating the shuttering 5 from the reinforcement trellis work 11 of the floor 3.

Then the concrete is poured, which is preferably achieved by means of a pump. After drying, only the side shuttering 4 is recoverable.

It will be noted that elements 12 of a resilient material may be advantageously disposed between the pin point foundations 1 and the rigid floor 3 so as to confer on the construction an anti-seismic character.

Figure 2:
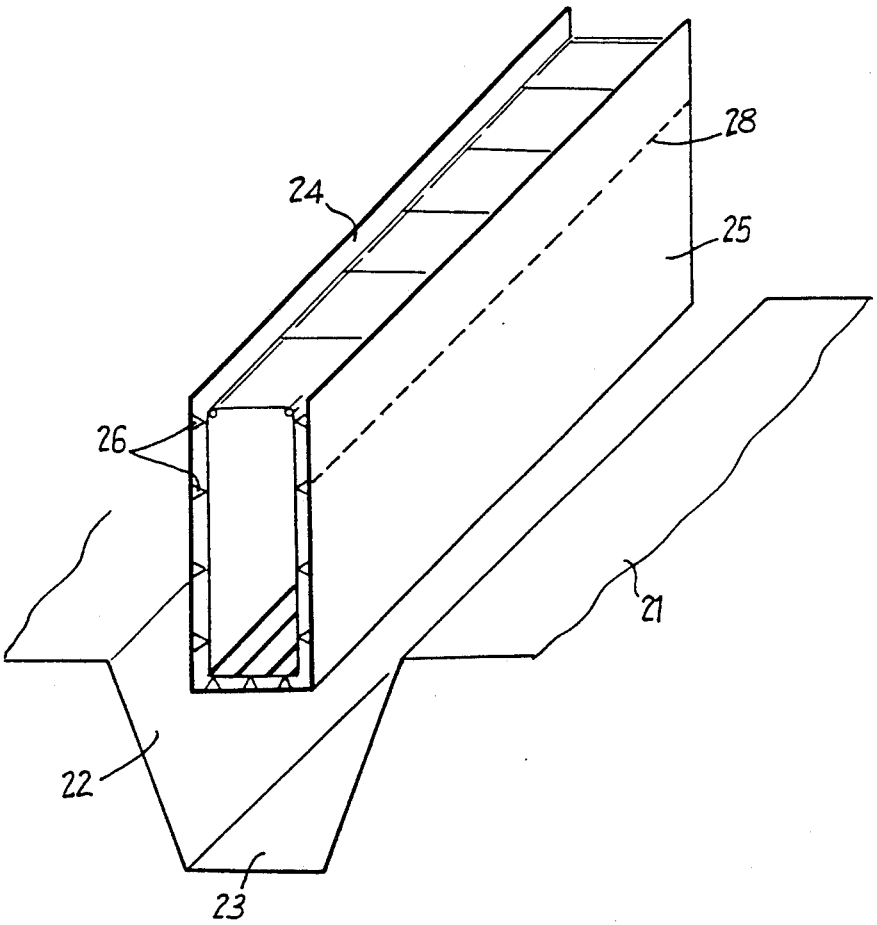
FIGS. 2 to 4 are schematical perspective views showing the successive constructional phases, in a variant of the process of the invention of a part of a floor with buried support beams.
Figure 3:
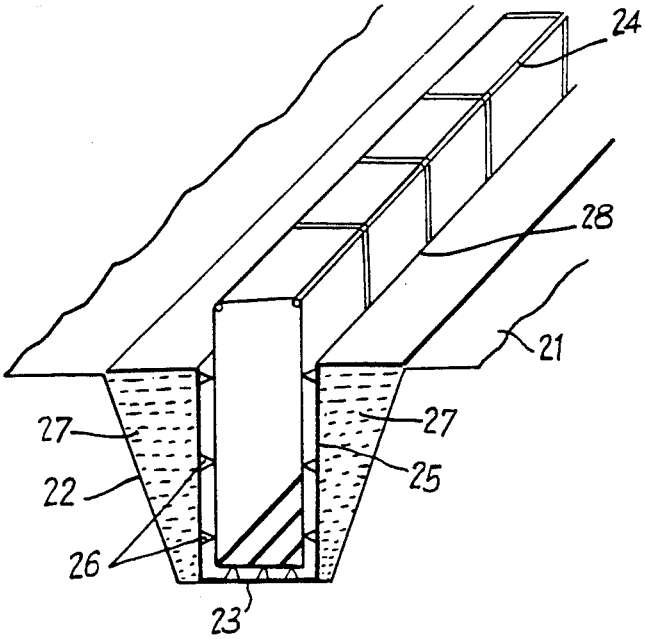
Figure 4:
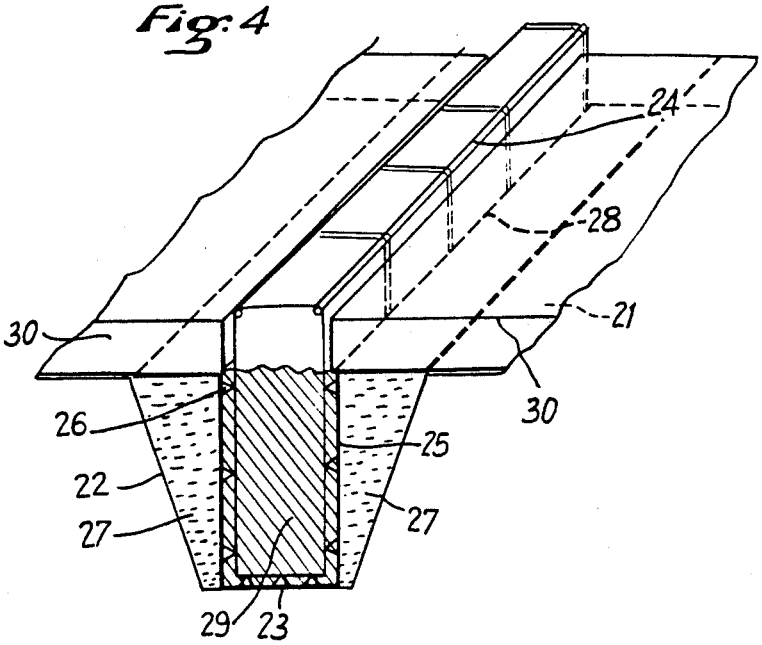

Referring to FIGS. 2 to 4, a variant of the process of the invention has been shown for constructing a floor comprising bearing beams of a height greater than that of the floor and intended to be partially buried in the ground. In these Figures the surface of the ground which has been levelled is shown at 21, at 22 an excavation for receiving a beam and on the well levelled bottom 23 of which is placed the structure 24 of the beam encased in a non recoverable shuttering 25. Structure 24 is formed by a metal trellis work and non recoverable shuttering 25 consists of a sheet of cardboard in the shape of a U. The spacers 26 of the trellis work of reinforcement 24 are advantageously fixed to shuttering 25, so that this latter may be readily positioned at the same time as the trellis work.

As shown in FIG. 3, between the excavation 22 and shuttering 25 is filled with earth 27 or sand, the shuttering being held at the correct distance from reinforcement 24 by the spacers 26. It will be readily understood that the volume of filling required depends on the excavation which has been carried out, which depends on the nature of the ground and on the holding power of the earth. This excavation will be made as close as possible to the dimensions of the shuttering 25 if the earth holds well. The nature of the soil consequently conditions the choice of the shuttering material. The closer the ground may be cut to a size very close to that of the beam to be formed, the lighter the shuttering may be, whereas the more the soil is powdery, the wider the excavation and the more rigid the shuttering material will have to be.

After filling (FIG. 3), the part of shuttering 25 extending above the buried level of the beam is folded back over the ground 21, and for this the vertical sides of the shutter 25 have a pre-cut 28 formed at the level of the floor to be cast.

After positioning of the reinforcement elements and of the lateral shuttering elements (not shown in the drawings) as well as the non recoverable shuttering elements 30 (shown in FIG. 4), in accordance with the process of the invention described in FIG. 3, the concrete 29 is then poured so as to form the beam and the floor at one and the same time, the pressure of the concrete during pouring being exerted on the filling earth.

Advantageously shuttering 25 may be provided with a sealing inner coating for preventing possible infiltration through under pressure and thus forming a sealed lining.

It will be understood that the above description has been given simply by way of example, without limitative character, and that constructional additions or modifications may be made without departing from the scope and spirit of the invention defined by the following claims.

We claim:

1. Process for constructing a ribbed and rigid floor slab for supporting a construction, which comprises the following steps:

(a) forming pin-point foundations at least at the periphery of the floor slab to be formed;

(b) preparing flat and levelled ground at the level of the pin-point foundations;

(c) disposing recoverable shuttering elements on the ground thus prepared, at the periphery of the floor slab to be formed;

(d) disposing on the ground surface, within said recoverable peripheral shuttering elements, parallel rows of non-recoverable shuttering elements which engage the ground by their whole lower face, said rows of non-recoverable shuttering elements being intended to form the ribs of the floor slab to be formed;

(e) disposing between the rows of non-recoverable shuttering elements U-shaped spacing elements made of a sealing material and of which the lower face engages the ground;

(f) disposing a metal trellis work on the upper face of the non-recoverable shuttering elements for reinforcing the floor slab to be formed; and (g) pouring concrete over the assembly thus formed.

2. Process according to claim 1 wherein said pin-point foundations comprise wells dug to the resistant layers of the ground and filled with concrete.

3. Process according to claim 1 for constructing a rigid floor slab on an uneven or rocky soil, wherein the pin-point foundations are flush with the level of the highest point of the soil, the peripheral shuttering elements are formed in two parts, a first part being flush with the level of the bottom of the floor slab to be formed and with the foundations while defining an irregular volume to be filled temporarily by means of sand or powderly material supporting the bottom of the floor and the non-recoverable shuttering, and the second part being formed by vertical shuttering elements of the thickness of the ribs plus a compression floor allowing the floor to be cast, and wherein the floor is then dried and the shuttering removed, the sand being eliminated naturally.

4. Process according to claim 1 for obtaining a slab floor comprising bearing beams of a height greater than that of the slab floor, wherein, after levelling of the soil and before positioning of the shuttering elements for the slab floor, excavations are made in the ground for housing the beams supporting the slab floor, a reinforcement element for said beams, contained inside a non-recoverable shuttering element, is disposed in each excavation, the region between the excavation and the non-recoverable shuttering element is filled in and the part of the non-recoverable shuttering extending above the buried level of the beam is folded back over the ground so that, after positioning of the outer shuttering elements and of the internal component elements of the floor slab, the floor and the beams are cast in a single operation.

5. Processing according to claim 4 wherein wedging means are used to hold the shuttering element at a suitable distance from the reinforcement during filling in.

6. Process according to claim 4 wherein means are used for spacing the reinforcement, said means being fixed to the shuttering element, in order to allow ready positioning of this latter at the same time as said reinforcement.

7. Process according to claim 4 wherein a material with a rigid and light surface, such as cardboard, wood fiber or plastic material is used for constructing the non-recoverable shuttering element.

8. Process according to claim 4 wherein the shuttering element receives inwardly a sealing coating.

* * * * *